US010619875B2

(12) United States Patent
Tanabe et al.

(10) Patent No.: US 10,619,875 B2
(45) Date of Patent: Apr. 14, 2020

(54) AIR-CONDITIONING SYSTEM

(71) Applicant: Mitsubishi Electric Corporation, Tokyo (JP)

(72) Inventors: Chika Tanabe, Tokyo (JP); Yasuyuki Takai, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 68 days.

(21) Appl. No.: 15/546,303

(22) PCT Filed: Mar. 31, 2015

(86) PCT No.: PCT/JP2015/060230
§ 371 (c)(1),
(2) Date: Jul. 26, 2017

(87) PCT Pub. No.: WO2016/157444
PCT Pub. Date: Oct. 6, 2016

(65) Prior Publication Data
US 2018/0017280 A1 Jan. 18, 2018

(51) Int. Cl.
*F24F 11/30* (2018.01)
*F24F 11/32* (2018.01)
(Continued)

(52) U.S. Cl.
CPC ..... *F24F 11/30* (2018.01); *F24F 3/065* (2013.01); *F24F 11/32* (2018.01); *F25B 49/027* (2013.01); *F28D 1/024* (2013.01); *F24F 11/37* (2018.01); *F24F 11/49* (2018.01); *F24F 11/50* (2018.01); *F24F 11/52* (2018.01); *F24F 11/56* (2018.01);
(Continued)

(58) Field of Classification Search
CPC ..... F24F 11/30; F24F 49/02; F24F 49/022; F24F 49/00; F24F 11/37; F24F 11/32; F24F 11/56; F24F 11/54
See application file for complete search history.

(56) References Cited

U.S. PATENT DOCUMENTS 5,592,824 A * 1/1997 Sogabe ..... F24F 11/00 62/127
2005/0226634 A1* 10/2005 Kuwata ..... H04B 10/66 398/155
2012/0078422 A1* 3/2012 Mejias ..... H05K 7/20836 700/277

FOREIGN PATENT DOCUMENTS

JP 2004-251467 A 9/2004
JP 2007-024431 A 2/2007

OTHER PUBLICATIONS

International Search Report of the International Searching Authority dated Jul. 7, 2015 for the corresponding international application No. PCT/JP2015/060230 (and English translation).

* cited by examiner

*Primary Examiner* — Edward F Landrum
*Assistant Examiner* — Alexis K Cox
(74) *Attorney, Agent, or Firm* — Posz Law Group, PLC

(57) ABSTRACT

A controller of an indoor unit included in an air-conditioning system determines whether or not a communication error with the outdoor unit is an energization error that only occurs during an energization time in which electric power is fed from a commercial power supply to the outdoor unit. The controller can also determine whether or not the communication error is a connection establishment error that occurs at a time of establishing a connection with the outdoor unit. Based on determining the cause of the communication error with the outdoor unit, the controller can
(Continued)

drive a fan by electric power fed from an emergency power supply.

7 Claims, 6 Drawing Sheets

(51) Int. Cl.

| | |
|---|---|
| ***F24F 3/06*** | (2006.01) |
| ***F25B 49/02*** | (2006.01) |
| ***F28D 1/02*** | (2006.01) |
| *F24F 11/49* | (2018.01) |
| *F24F 11/63* | (2018.01) |
| *F24F 11/37* | (2018.01) |
| *F24F 11/50* | (2018.01) |
| *F24F 11/56* | (2018.01) |
| *F24F 11/52* | (2018.01) |

(52) U.S. Cl.
CPC ..... *F24F 11/63* (2018.01); *F25B 2400/071* (2013.01); *F25B 2600/111* (2013.01)

AIR-CONDITIONING SYSTEM

CROSS REFERENCE TO RELATED APPLICATION

This application is a U.S. national stage application of PCT/JP2015/060230 filed on Mar. 31, 2015, the contents of which are incorporated herein by reference.

TECHNICAL FIELD

The present invention relates to an air-conditioning system having an emergency power supply in an indoor unit.

BACKGROUND

A conventional air-conditioning system that has an emergency power supply to supply electric power during an emergency (such as a commercial power supply failure), and that is configured to be operated by a commercial power supply during normal operation has been known. The air-conditioning system includes one or both of a battery and a private power generator (Patent Literature 1, for example) as an emergency power supply.

In the air-conditioning system of Patent Literature 1, when the feeding state is switched to a state where power is fed from an emergency power supply due to power failure or other factor, the emergency power supply transmits a power feeding signal to a controller. In response, the controller that received the power feeding signal from the emergency power supply sets the compressor to its lowest frequency and sets the fan to its lowest air flow rate.

CITATION LIST

Patent Literature

Patent Literature 1: Japanese Unexamined Patent Application Publication No. 2007-24431

SUMMARY

Technical Problem

However, the air-conditioning system of Patent Literature 1 requires a separate hardware component to issue a notification that an interruption has occurred in the power being supplied from the commercial power supply. Consequently, a system is desired that detects an interruption of power being supplied from a commercial power supply without having a specially designed hardware component.

The present invention has been made in view of the problem described above. An object of the present invention is to provide an air-conditioning system that can detect an interruption of power to an outdoor unit without having an additional hardware component.

Solution to Problem

An air-conditioning system of one embodiment of the present invention includes an indoor unit having a fan, an outdoor unit connected with the indoor unit via a refrigerant pipe and configured to perform transmission and reception of a communication signal with the indoor unit, and an emergency power supply connected to the indoor unit and configured to feed electric power to the indoor unit during a power failure. The indoor unit includes a controller that controls operation of the fan based on a communication state with the outdoor unit. The controller includes an energization-time error determination unit that, when a communication error occurs in communication with the outdoor unit, determines whether or not the communication error is an energization-time error that only occurs during an energization time when electric power is fed from a commercial power supply to the outdoor unit, a connection establishment error determination unit that, when the energization time error determination unit determines that the communication error is not the energization time error, determines whether or not the communication error is a connection establishment error that occurs at a time of establishing a connection with the outdoor unit, to detect power failure in the outdoor unit, and a fan control unit that, when the connection establishment error determination unit determines that the communication error was the connection establishment error, drives the fan by the electric power fed from the emergency power supply.

Advantageous Effects

According to one embodiment of the present invention, the controller provided to the indoor unit analyzes a communication error that occurs in a communication signal transmitted and received with the outdoor unit to determine whether or not power supply to the outdoor unit is interrupted on the basis of a communication state between the indoor unit and the outdoor unit. Consequently, it is possible to detect interruption of power fed to the outdoor unit without having a hardware component additionally.

DESCRIPTION OF EMBODIMENTS

Embodiment 1

Figure 1:
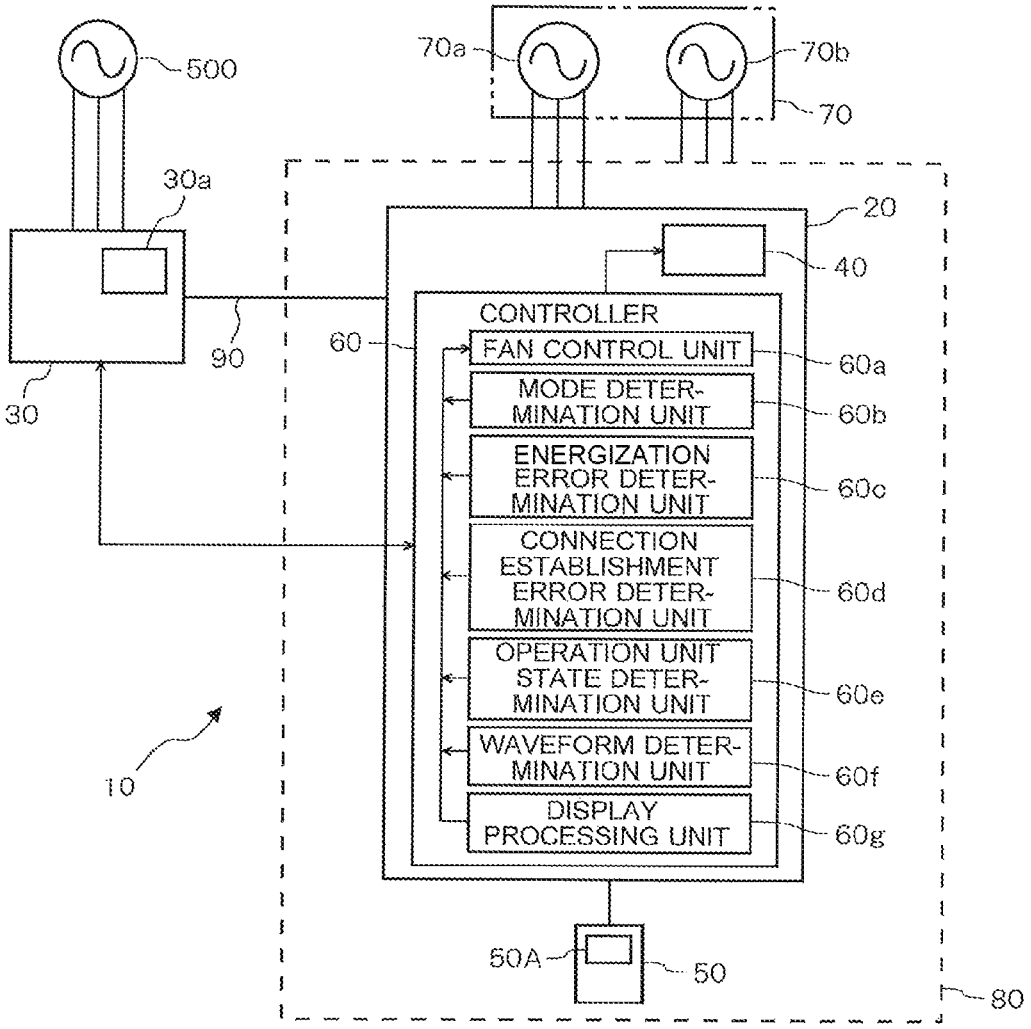
FIG. 1 is a block diagram illustrating a configuration of an air-conditioning system according to Embodiment 1 of the present invention.

FIG. 1 is a block diagram illustrating a configuration of an air-conditioning system according to Embodiment 1. As illustrated in FIG. 1, an air-conditioning system 10 includes an indoor unit 20 having a fan 40, an outdoor unit 30 connected with the indoor unit 20 via a refrigerant pipe 90 and configured to perform transmission and reception of a communication signal with the indoor unit 20, an indoor operation unit 50 to which electric power is fed from the indoor unit 20 and that receives air-conditioning and ventilation operation including operation of driving the fan 40, and an emergency power supply 70 connected with the indoor unit 20 and configured to feed electric power to the indoor unit 20 during a power failure due to interruption of power feeding from a commercial power supply 500.

Figure 2:
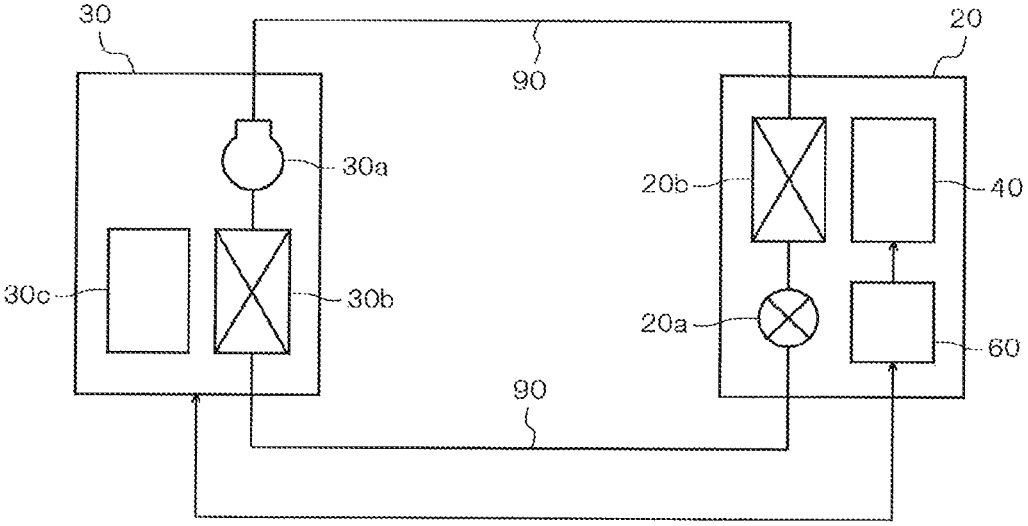
FIG. 2 is a block diagram illustrating a connection relationship between an indoor unit and an outdoor unit of the air-conditioning system of FIG. 1.

Here, a schematic configuration of a refrigerant circuit in the air-conditioning system 10 will be described with reference to FIG. 2. FIG. 2 is a block diagram illustrating a connection relation between the indoor unit 20 and the outdoor unit 30 of the air-conditioning system 10. The indoor unit 20 includes a decompression device 20*a*, an evaporator 20*b*, the fan 40, and a controller 60.

The outdoor unit 30 includes a compressor 30*a*, a condenser 30*b*, and an outdoor fan 30*c*. The compressor 30*a*, the condenser 30*b*, the decompression device 20*a*, and the evaporator 20*b* are connected in series by refrigerant pipes 90 to form a refrigerant circuit. The refrigerant pipe 90 is formed to allow refrigerant to flow through the refrigerant pipe 90.

The fan 40 sends air to the indoor space. The indoor operation unit 50 is, for example, a remote control (or a contact type input device) and has a display unit 50*a*, which displays various types of information. The indoor operation unit 50 receives operations related to start-stop control and rotation frequency control of the fan 40 and executes them. The emergency power supply 70 includes an indoor unit power supply 70*a* for feeding power to the indoor unit 20 during an emergency, and a critical-area power supply 70*b* for feeding power into a critical power area 80, which includes the indoor unit 20 and the indoor operation unit 50 during an emergency.

The air-conditioning system 10 of Embodiment 1 is configured to perform operation control of the fan 40 by the power fed from the emergency power supply 70 only. This means that the air-conditioning system 10 is configured such that power fed from the emergency power supply 70 to outdoor unit 30 is not required so that the system is able to operate in a Business Continuity Plan (BCP). Consequently, it is possible to secure a minimum air-conditioning environment at a cost lower than the conventional air-conditioning system. Here, BCP means a state where device operation and environmental adjustment can be performed continuously during an emergency that is not a normal power feeding state (a normal power feeding state is referred to as an energization period). The time of BCP is assumed as a state where the power is restored to the indoor unit 20 by the backup power fed from the emergency power supply 70 in response to an interruption of the power fed from the commercial power supply 500. It should be noted that the energization period means a state where the power is fed from the commercial power supply 500 to the outdoor unit 30 That is, the energization period is a normally operating state where the power to run the air-conditioning system 10 is covered by the a commercial power supply 500.

As operation modes, the controller 60 operates in an air sending mode in which operation of the compressor 30*a* (illustrated in FIG. 2) provided to the outdoor unit 30 is not needed, and the controller 60 operates in a cooling mode, a dry mode, and a heating mode in which operation of the compressor 30*a* is needed. In the cooling mode, the dry mode, and the heating mode, air-conditioning is performed by allowing refrigerant to flow between the indoor unit 20 and the outdoor unit 30. The controller 60 controls, for example, operation of the fan 40 based on a communication state with the outdoor unit 30.

The controller 60 includes a fan control unit 60*a* that performs rotation frequency control including start-stop control of the fan 40, a mode determination unit 60*b* that determines whether or not the operation mode before power failure was the air sending mode, an energization error determination unit 60*c* that, when a communication error occurs in the communication with the outdoor unit 30, determines whether or not the communication error is an energization error that only occurs when the power is fed from the commercial power supply 500 to the outdoor unit 30, and a connection establishment error determination unit 60*d* that, when the energization error determination unit 60*c* determines that the communication error is not due to an energization error, determines whether or not the communication error is due to a connection establishment error (a no-Ack error in which an acknowledgement, Ack, is not received) with the outdoor unit 30.

The controller 60 also includes an operation unit state determination unit 60*e* that, when the connection establishment error determination unit 60*d* determines that the communication error is not a connection establishment error, determines whether or not operation control by the indoor operation unit 50 is possible, a waveform determination unit 60*f* that, when the operation unit state determination unit 60*e* determines that operation control by the indoor operation unit 50 is possible, determines presence or absence of a waveform deformation in a communication signal transmitted and received between the indoor unit 20 and the outdoor unit 30, and a display processing unit 60*g* that displays various types of information on the display unit 50*a*.

When the power fed from the commercial power supply 500 is interrupted, the fan control unit 60*a* controls a driving state of the fan 40 by the power fed from the emergency power supply 70. The fan control unit 60*a* drives the fan 40 when the connection establishment error determination unit 60*d* determines that a connection establishment error occurs. When the connection establishment error determination unit 60*d* determines that a connection establishment error occurs and the mode determination unit 60*b* determines that the mode is an air sending mode, the fan control unit 60*a* sets a permission to permit rotation frequency control of the fan 40 by the indoor operation unit 50. The fan control unit 60*a* drives the fan 40 when the operation unit state determination unit 60*e* determines that communication with the indoor operation unit 50 is ensured. The fan control unit 60*a* sets permission when the waveform determination unit 60*f* determines that no waveform deformation is present. The fan control unit 60*a* sets permission when the waveform determination unit 60*f* determines that waveform deformation is present and the mode determination unit 60*b* determines that the mode is an air sending mode.

The air-conditioning system 10 of Embodiment 1 is configured such that, immediately after the power restoration when the power feeding is switched to the emergency power supply 70 and the power feeding from the emergency power supply 70 to the indoor unit 20 starts, the setting state reproduces the operation mode before the power failure. This means that the fan control unit 60*a* is configured to drive the fan 40 in an operation state in which the fan 40 is driven before the power failure. However, the configuration of the air-conditioning system 10 is not limited to a configuration of reproducing the setting state before the power failure. For example, the air-conditioning system 10 may be configured such that the fan control unit 60*a* drives the fan 40 in a predetermined fixed setting state in such a manner that the fan control unit 60*a* always drives the fan 40 or always stops the fan 40 after the power is restored by the emergency power supply 70. Then, after the power is restored by the emergency power supply 70, the operating state can be changed by the operation from the indoor operation unit 50 in the case where the state of the outdoor unit 30 satisfies a predetermined condition. This means that, in the case where permission is set by the fan control unit 60*a*, when an operation state change command is received via the indoor operation unit 50, the indoor unit 20 operates in accordance with the received change command.

It should be noted that communication errors include an error related to BCP that occurs during both the energization time and the BCP time (e.g., no-Ack error or hardware error), and an energization error that only occurs during the energization time. Consequently, when an energization error occurs, it is considered that such a time is not the BCP time. Consequently, in Embodiment 1, the air-conditioning system 10 is configured to detect interruption of the power fed from the commercial power supply 500 when a communication error occurring in a communication signal is neither an energization error nor a connection establishment error. This means that the connection establishment error determination unit 60*d* detects power failure in the outdoor unit 30. Consequently, the air-conditioning system 10 can detect interruption of the power fed from the commercial power supply 500 by the energization time error determination unit 60*c* and the connection establishment error determination unit 60*d* from a communication state between the indoor unit 20 and the outdoor unit 30, without having a configuration of reliably detecting interruption of power fed to the outdoor unit 30.

The mode determination unit 60*b* has a stopped state determination function of determining whether or not the operation state before power failure is a stopped state. The fan control unit 60*a* is configured to maintain the stopped state of the fan 40 when the mode determination unit 60*b* determines that the fan 40 is in a stopped state. The energization time error determination unit 60*c* has a no-response error determination function of determining whether or not a communication error determined to be an energization time error is a no-response error representing a state of no response from the outdoor unit 30. A no-response error is an error of the case where Ack from the outdoor unit 30 is received but no response is made. A no-response error includes the case where the outdoor unit 30 is in preparation for a part of communication and functions, so that a response is delayed.

An error other than a no-response error may be a Busbusy error, a driver error, or other related error. In the case of a Busbusy error or a driver error, the state of the device is unknown since it is highly likely that not only communication with the outdoor unit 30 but also communication with other devices are impossible. Consequently, Embodiment 1 is configured such that, when the energization time error determination unit 60*c* determines that an error is a no-response error, the fan control unit 60*a* stops driving of the fan 40 in consideration of safety.

As described above, the operation unit state determination unit 60*e* determines whether or not the current state is a state where operation control by the indoor operation unit 50 is possible. A state where operation control by the indoor operation unit 50 is possible means, for example, a state where communication with the indoor operation unit 50 is ensured, a state where start-stop operation and an operation related to rotation frequency control of the fan 40 by the indoor operation unit 50 are set to be valid, or a state where contact control of the fan 40 is valid. A state where an operation from the indoor operation unit 50 is impossible from among the states where operation control of the fan 40 is impossible includes a state where a user is not able to instruct the indoor unit 20 to control the fan 40 because, for example, the wiring of the indoor operation unit 50 is disconnected.

In Embodiment 1, the operation unit state determination unit 60*e* has a function of determining whether or not communication with the indoor operation unit 50 is ensured. The waveform determination unit 60*f* has a function of determining whether or not a waveform deformation is present in a communication signal, when it is determined that communication with the indoor operation unit 50 is established. The waveform determination unit 60*f* determines whether or not a waveform deformation is present in a communication signal to determine whether or not a hardware error (H/W error) occurs.

Then, in the air-conditioning system 10, when the energization state is restored in which power is fed from the commercial power supply 500 to the outdoor unit 30 after the power failure (when power is restored by the commercial power supply 500), the state is transferred to a normal operation state where the rotation frequency control of the fan 40 is not limited and refrigerant operation (operation of the compressor 30*a*) is possible. More specifically, the outdoor unit 30 has a function of outputting an error clear request indicating that power is restored when the power is restored by the commercial power supply 500. The energization time error determination unit 60*c* has a function of determining whether or not an error not caused by interruption of power feeding occurs in a communication signal after the error clear, when an error clear request is output from the outdoor unit 30. In Embodiment 1, the energization time error determination unit 60*c* is configured to use an energization time error as an error not caused by interruption of power feeding. The fan control unit 60*a* is configured to set permission when the energization time error determination unit 60*c* determines that an energization time error does not occur in the communication signal.

Figure 3:
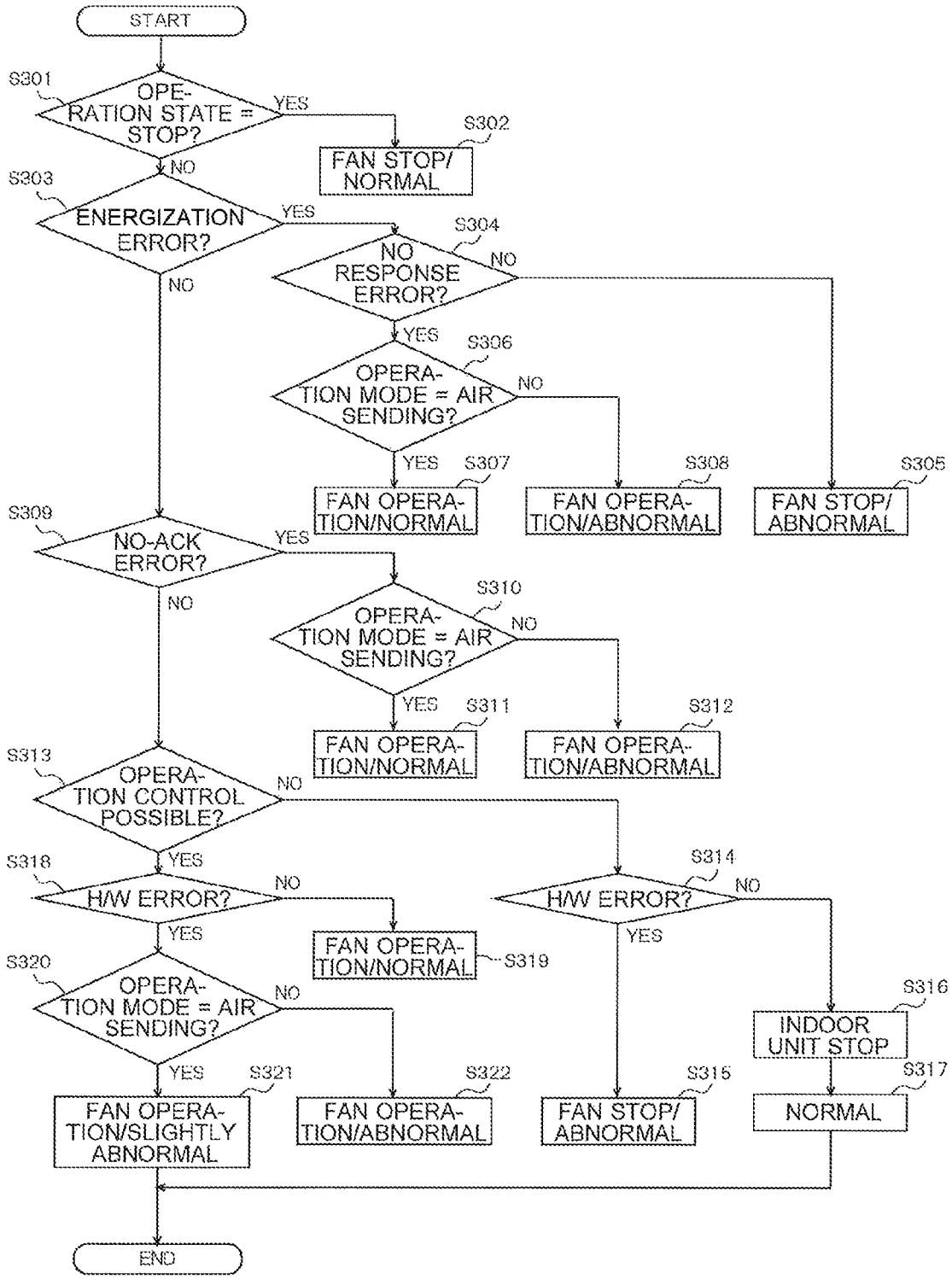
FIG. 3 is a flowchart of an operation of the air-conditioning system of FIG. 1.

Next, operation of the air-conditioning system 10 will be described with reference to FIG. 3. FIG. 3 is a flowchart of an operation of the air-conditioning system 10. The air-conditioning system 10 determines presence or absence of various types of errors as described below on the basis of the communication state between the indoor unit 20 and the outdoor unit 30, and performs rotation frequency control of the fan 40 including start-stop control.

First, the indoor unit 20 checks the operation mode before the power failure. This means that when a communication error occurs in the communication with the outdoor unit 30, the mode determination unit 60*b* determines whether or not the operation state before the power failure is a stopped state, by the stopped state determination function (FIG. 3: step S301). When the mode determination unit 60*b* determines that the state is a stopped state (FIG. 3: step S301, YES), the fan control unit 60*a* determines that the state is a normal state, and maintains the stopped state of the fan 40. The display processing unit 60*g* displays the fact that the state is a stopped state, on the display unit 50*a* (FIG. 3: step S302). On the other hand, when the mode determination unit 60*b* determines that the state is not a stopped state (FIG. 3: step S301, NO), the energization time error determination unit 60*c* determines whether or not the communication error is an energization time error peculiar to the energization time (FIG. 3: step S303).

When the energization time error determination unit 60*c* determines that the communication error is an energization time error (FIG. 3: step S303, YES), the energization time error determination unit 60*c* further determines whether or not the communication error is a no-response error (FIG. 3:

step S304). Step S304 is a step for determining whether or not control of the fan 40 has been affected.

When the energization time error determination unit 60*c* determines that the communication error is not a no-response error (FIG. 3: step S304, NO), the fan control unit 60*a* determines that an abnormality occurs, and stops the fan 40. The display processing unit 60*g* displays the fact that abnormality occurs on the display unit 50*a*. At step S304, when the communication error is not a no-response error, the state of the device is unknown because it is highly likely that not only communication with the outdoor unit 30 but also communication with other devices cannot be made. Consequently, in Embodiment 1, the fan 40 is stopped in consideration of safety (FIG. 3: step S305).

When the energization time error determination unit 60*c* determines that the communication error is a no-response error (FIG. 3: step S304, YES), the mode determination unit 60*b* determines whether or not the operation mode before the power failure is an air sending mode. This means that the mode determination unit 60*b* determines whether the operation mode before the power failure is an air sending mode, or a cooling mode, a dry mode, or a heating mode requiring operation of the compressor 30*a* (FIG. 3: step S306).

When the mode determination unit 60*b* determines that the operation mode is an air sending mode (FIG. 3: step S306, YES), the fan control unit 60*a* determines that operation is in a normal state, and sets permission to permit rotation frequency control of the fan 40 by the indoor operation unit 50. The fan control unit 60*a* also starts operation of the fan 40 and continues it, because operation of the fan 40 in the air sending mode can be made regardless of the state of the outdoor unit 30. The display processing unit 60*g* displays the fact that operation is in a normal state on the display unit 50*a* (FIG. 3: step S307).

When the mode determination unit 60*b* determines that the operation mode is one other than the air sending mode, that is, an operation mode requiring refrigerant control (FIG. 3: step S306, NO), the fan control unit 60*a* determines that an abnormality occurs, and sets non-permission to not permit rotation frequency control of the fan 40 by the indoor operation unit 50. Further, as the state of the device is known, which is different from step S305, the fan control unit 60*a* starts operation of the fan 40. The display processing unit 60*g* displays the fact that an abnormality occurs on the display unit 50*a* (FIG. 3: step S308).

When the energization time error determination unit 60*c* determines that the communication error is not an energization time error (FIG. 3: step S303, NO), the connection establishment error determination unit 60*d* determines whether or not the communication error is a connection establishment error (no-Ack error) (FIG. 3: step S309). When the connection establishment error determination unit 60*d* determines that the communication error is a connection establishment error (FIG. 3: step S309, YES), the mode determination unit 60*b* determines whether or not the operation mode before the power failure was an air sending mode (FIG. 3: step S310).

When the mode determination unit 60*b* determines that the mode was an air sending mode (FIG. 3: step S310, YES), the fan control unit 60*a* determines that the state is a normal state, and sets permission, and then starts operation of the fan 40. The display processing unit 60*g* displays the fact that the state is a normal state on the display unit 50*a* (FIG. 3: step S311).

When the mode determination unit 60*b* determines that the mode is not an air sending mode (FIG. 3: step S310, NO), the fan control unit 60*a* determines that an abnormality occurs, sets non-permission, and starts operation of the fan 40. The display processing unit 60*g* displays the fact that an abnormality occurs on the display unit 50*a* (FIG. 3: step S312).

When the connection establishment error determination unit 60*d* determines that the communication error is not a connection establishment error (FIG. 3: step S309, NO), the operation unit state determination unit 60*e* determines whether or not operation control by the indoor operation unit 50 is possible. This means that the operation unit state determination unit 60*e* checks whether or not communication with the indoor operation unit 50 is established, whether a start-stop operation and an operation related to rotation frequency control of the fan 40 by the indoor operation unit 50 are set to be valid, or whether or not contact control of the fan 40 is valid, for example (FIG. 3: step S313).

When the operation unit state determination unit 60*e* determines that operation control by the indoor operation unit 50 is impossible (FIG. 3: step S313, NO), the waveform determination unit 60*f* determines presence or absence of a waveform deformation in a communication signal transmitted and received between the indoor unit 20 and the outdoor unit 30 in order to determine whether or not the error is a hardware error (H/W error) (FIG. 3: step S314).

When the waveform determination unit 60*f* determines that a waveform deformation is present (FIG. 3: step S314, YES), a transmission circuit (not illustrated) of the indoor unit 20 may be broken, and when the transmission circuit is broken, there is no method to stop the fan 40. Consequently, the fan control unit 60*a* determines that an abnormality occurs, and stops the fan 40 for safety. The display processing unit 60*g* displays the fact that abnormality occurs on the display unit 50*a* (FIG. 3: step S315).

When the waveform determination unit 60*f* determines that no waveform deformation is present (FIG. 3: step S314, NO), the transmission circuit of the indoor unit 20 is normal but communication with the indoor operation unit 50 is not possible for some reason. Consequently, the controller 60 stops operation of the indoor unit 20 (FIG. 3: step S316). Step S316 is an operation incorporated in consideration of safety, because, in a state where communication with the indoor operation unit 50 is impossible, a start-stop operation from the indoor operation unit 50 at the time of emergency is also impossible. The display processing unit 60*g* displays the fact that the transmission circuit is in a normal state on the display unit 50*a* (FIG. 3: step S317).

Even when the operation unit state determination unit 60*e* determines that operation control by the indoor operation unit 50 is possible (FIG. 3: step S313, YES), the waveform determination unit 60*f* determines whether or not a waveform deformation is present in a communication signal from the indoor unit 20 to the outdoor unit 30 to determine whether or not the error is a hardware error (H/W error) (FIG. 3: step S318).

When the waveform determination unit 60*f* determines that no waveform deformation is present (FIG. 3: step S318, NO), the fan control unit 60*a* determines that the state is a normal state and sets permission, and starts operation of the fan 40. The display processing unit 60*g* displays the fact that the state is a normal state on the display unit 50*a* (FIG. 3: step S319). When the waveform determination unit 60*f* determines that a waveform deformation is present (FIG. 3: step S318, YES), the mode determination unit 60*b* determines whether or not the operation mode before the power failure is an air sending mode (FIG. 3: step S320).

When the mode determination unit 60*b* determines that the mode is an air sending mode (FIG. 3: step S320, YES), the fan control unit 60*a* determines that a slight abnormality occurs, and starts operation of the fan 40 and continues it. The display processing unit 60*g* displays the fact that a slight abnormality occurs on the display unit 50*a* (FIG. 3: step S321). Here, a slight abnormality means a slight abnormality in which changes can be allowed, for example, in the rotation frequency and in the operation mode of the fan 40.

When the mode determination unit 60*b* determines that the mode is an operation mode other than the air sending mode (FIG. 3: step S320, NO), the fan control unit 60*a* determines that an abnormality occurs and sets non-permission, and starts operation of the fan 40. The display processing unit 60*g* displays the fact that an abnormality occurs on the display unit 50*a* (FIG. 3: step S322).

As described above, the air-conditioning system 10 of Embodiment 1 is configured such that the controller 60 provided to the indoor unit 20 analyzes a communication error that occurs in a communication signal transmitted and received between the indoor unit 20 and the outdoor unit 30 to thereby determine whether or not the power fed to the outdoor unit 30 is interrupted. Consequently, it is possible to detect that power feeding from the commercial power supply 500 is interrupted, on the basis of the communication state between the indoor unit 20 and outdoor unit 30, without having an additional hardware component. Further, the controller 60 is configured to determine whether or not to allow start-stop control of the fan 40 and rotation frequency control of the fan through input to the indoor operation unit 50 on the basis of the communication state with the outdoor unit 30. Consequently, as a level at which driving of the fan 40 is allowed can be recognized, even during an emergency, it is possible to operate the indoor unit 20 in a state where the function is limited. In the conventional air-conditioning apparatus, the rotation frequency of the fan is fixed when using the emergency power supply, so it is impossible to respond to the need of changing the fan start-stop state (on→off, off→on) or changing the air flow rate of the fan to correspond to the situation and the environment. However, the air-conditioning system 10 can change the start-stop state and the air flow rate of the fan even at the time of using the emergency power supply 70 by the processing based on the communication state with the outdoor unit 30.

Further, the conventional air-conditioning system is configured to feed electric power to both the indoor unit and the outdoor unit by the emergency power supply. Consequently, it is difficult to secure minimum operation of the indoor unit by connecting a battery of small capacity, and it is necessary to have an emergency power supply having a battery of large capacity. Meanwhile, the air-conditioning system 10 is configured to feed electric power to the urgent power feeding area 80 including the indoor unit 20 and the indoor operation unit 50 by the emergency power supply 70. Consequently, in the air-conditioning system 10, it is not necessary to feed power to the outdoor unit 30 during an emergency. Thus, it is possible to adopt a private power generator or other related element having a small capacity sufficient to secure minimum operation of the indoor unit 20 and the indoor operation unit 50 as the emergency power supply 70. Thus, even in the state where power for the outdoor unit 30 is not fed and operation of the compressor 30*a* cannot be made by the emergency power supply 70 of a small capacity, it is possible to secure operation control and air flow rate operation of the fan 40 and to attain flexible ventilation operation.

The air-conditioning system 10 has a configuration of not only determining whether or not to continue operation of the fan 40, but also determining, in stages, a normal state, a state where a slight abnormality occurs, and a state where an abnormality occurs, and determining the operation propriety of the fan 40 corresponding to the result of the determination. Consequently, the air-conditioning system 10 can attain rotation frequency control of the fan 40 to correspond to the operation state such as an operation mode and each of the staged states even during an emergency in which power feeding is different from that in the normal state.

It should be noted that while FIG. 1 exemplarily illustrates the case where the air-conditioning system 10 includes one indoor unit 20, the present invention is not limited to this configuration. The air-conditioning system 10 may include two or more indoor units 20. This means that, in Embodiment 1, the number of indoor units 20 provided to the air-conditioning system may vary depending on the environment of the site. Consequently, the capacity of a capacitor for securing power to allow the outdoor unit 30 to reliably communicate the fact of interruption of the power feeding to all of the indoor units 20, after interruption of the power feeding to the outdoor unit 30, varies depending on the number of indoor units 20, the connection environment, and other factors. In particular, it is unrealistic to mount, on the outdoor unit 30, a capacitor having a large capacity corresponding to the case where a large number of indoor units 20 are connected. Meanwhile, in the air-conditioning system 10, the BCP state (outdoor unit side power feeding interrupted state) can be detected by determining the type of an error that occurs corresponding to the communication state with the outdoor unit 30. Consequently, it is possible to attain ventilation and air conditioning with a minimum configuration without adding a specially designed hardware component.

Further, in FIG. 2, an indoor fan provided to the indoor unit 20 is exemplarily illustrated as the fan 40. However, the present invention is not limited to this configuration. For example, the controller 60 may control the rotation frequency of a fan of a ventilation device, a fan of an outdoor air processing device (outdoor air intake device), or other related component as described below. This means that a ventilation device or an outdoor air processing device may be provided instead of the indoor unit 20.

Embodiment 2

Figure 4:
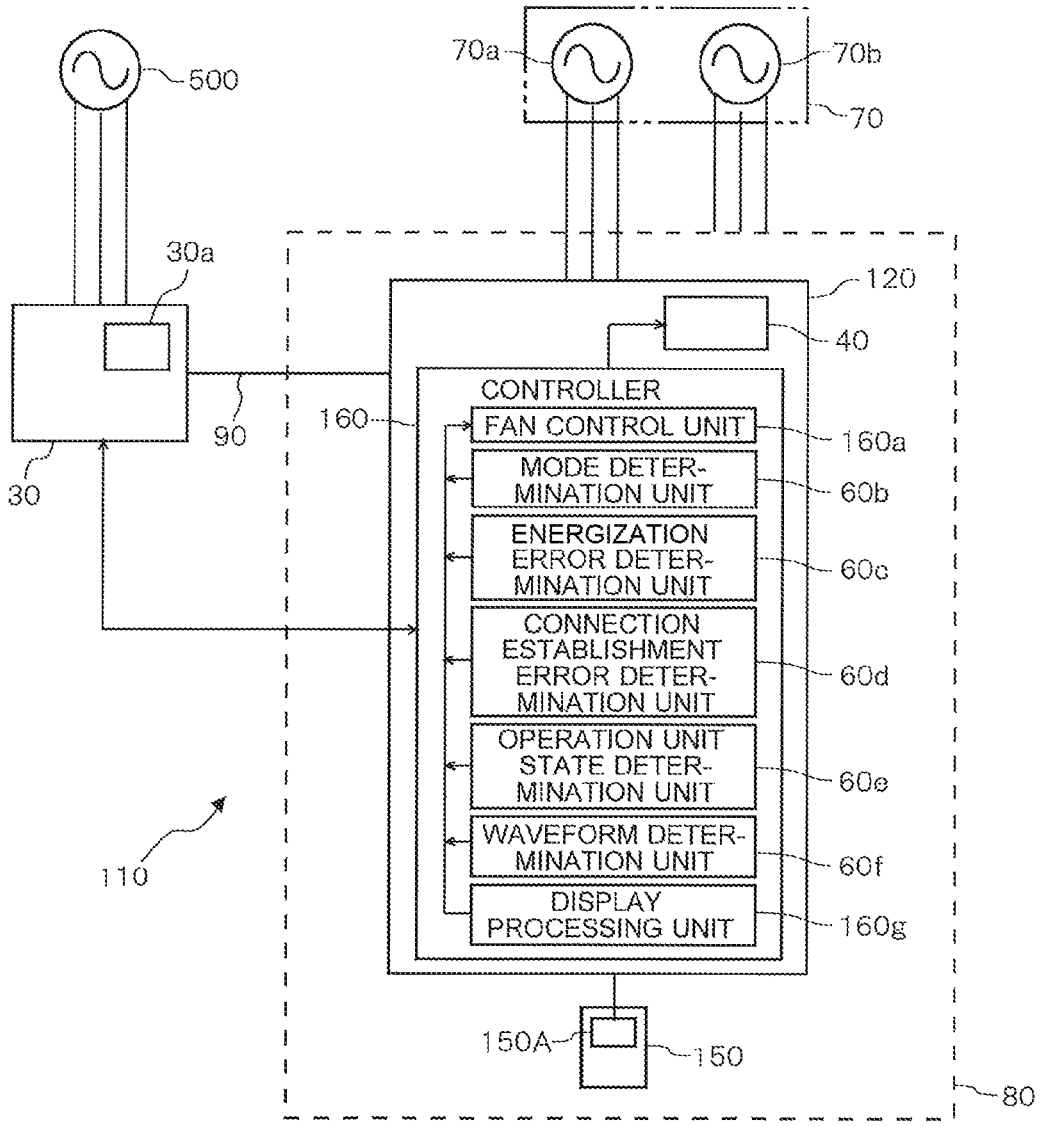
FIG. 4 is a block diagram illustrating a configuration of an air-conditioning system according to Embodiment 2 of the present invention.

Next, an air-conditioning system of Embodiment 2, in which propriety setting of fan operation is discriminated between one for the time of BCP and another for the energization time, will be described with reference to FIGS. 4 and 5. FIG. 4 is a block diagram illustrating a configuration of an air-conditioning system 110 according to Embodiment 2. The same components as those of Embodiment 1 are denoted by the same reference signs and the description is omitted.

The air-conditioning system 110 is configured to determine the power feeding interrupted state of the outdoor unit 30 from the communication state between an indoor unit 120 and the outdoor unit 30, similarly to the case of Embodiment 1. This means that a no-Ack error shown at step S309 and a H/W error shown at step S318 are errors that occur in both the energization time and the BCP time, so that the energization time error determination unit 60*c* may determine that the outdoor unit 30 is in a power failure state at step S303, from not only the power feeding interrupted state but also another factor such as disconnection of wiring and contact failure. In view of the above, the air-conditioning system 110 of Embodiment 2 adopts a configuration in which propriety setting of fan operation is selectable when a communication error is an error related to BCP.

As illustrated in FIG. 4, a controller 160 of the air-conditioning system 110 includes a fan control unit 160*a* that controls a driving state of the fan 40 in the same manner as that of the fan control unit 60*a* of Embodiment 1, and a display processing unit 160*g* that displays various types of information on a display unit 150*a* provided to an indoor operation unit 150. The fan control unit 160*a* has a permission determining function of determining whether or not to set permission to permit rotation frequency control of the fan 40 by the indoor operation unit 150 when a communication error is an error related to BCP.

The display unit 150*a* displays a selection request of whether or not to set permission (selection request screen). The display processing unit 160*g* displays a selection request on the display unit 150*a* when the mode determination unit 60*b* determines that the mode is an operation mode other than the air sending mode. The fan control unit 160*a* is configured to set permission when permission of rotation frequency control of the fan 40 is input from the indoor operation unit 150, in response to the selection request displayed on the display unit 150*a* by the display processing unit 160*g*.

Further, in the case where the mode determination unit 60*b* determines that the mode is an operation mode other than the air sending mode, the fan control unit 160*a* may set permission when permission of rotation frequency control of the fan 40 at the time of BCP is input in advance. It should be noted that permission of rotation frequency control of the fan 40 may be stored in a storage unit (not illustrated) provided inside or outside the controller 60 when the permission is input from the outside so that the fan control unit 160*a* can refer to the permission when the fan control unit 160*a* determines whether or not to set the permission.

Next, operation of the air-conditioning system 110 will be described with reference to FIG. 5. FIG. 5 is a flowchart of an operation of the air-conditioning system 110. First, the controller 160 performs processing of steps S301 to S311, as in the case of FIG. 3.

Figure 5:
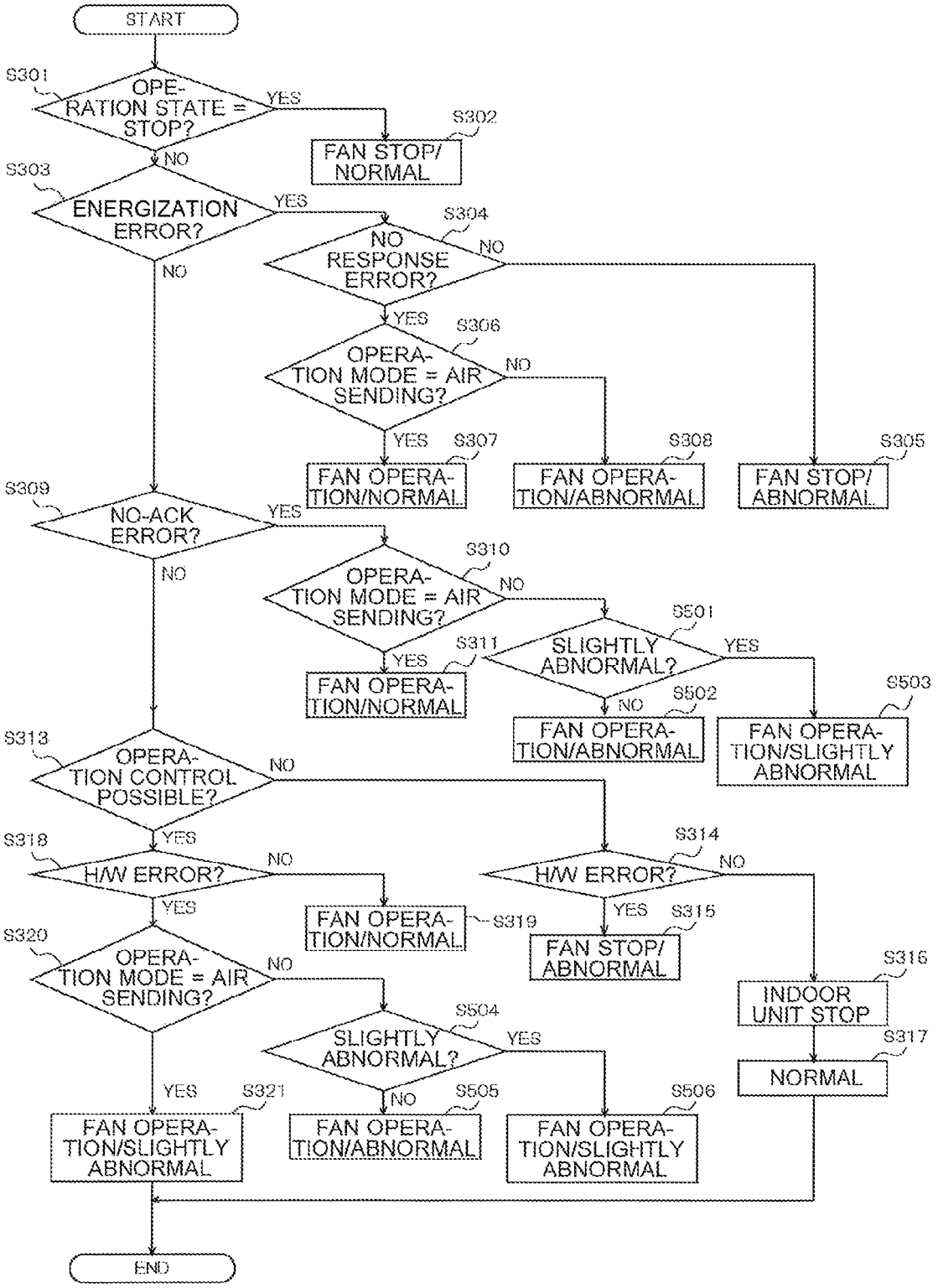
FIG. 5 is a flowchart of an operation of the air-conditioning system of FIG. 4.

Next, when the mode determination unit 60*b* determines that the mode is not an air sending mode (FIG. 5: step S310, NO), the fan control unit 160*a* determines whether or not to make a setting for a slight abnormality at the time of BCP, that is, whether or not to set permission at the time of BCP (FIG. 5: step S501).

When the fan control unit 160*a* determines not to make a setting for a slight abnormality (FIG. 5: step S501, NO), the fan control unit 160*a* sets non-permission, and starts operation of the fan 40. The display processing unit 160*g* displays the fact that an abnormality occurs, on the display unit 150*a* (FIG. 5: step S502). On the other hand, when the fan control unit 160*a* determines to make a setting for a slight abnormality (FIG. 5: step S501, YES), the fan control unit 160*a* sets permission, and starts operation of the fan 40. The display processing unit 160*g* displays the fact that a slight abnormality occurs on the display unit 150*a* (FIG. 5: step S503).

It should be noted that when a communication error is an error related to BCP, the fan control unit 160*a* may determine whether or not to make a setting for a slight abnormality, in accordance with the selection by the user. The fan control unit 160*a* may also be configured to determine to make a setting for a slight abnormality, in the case where the condition that rotation frequency control of the fan 40 is not allowed at the time of BCP is stored in advance (FIG. 5: step S501).

This means that when the mode determination unit 60*b* determines that the mode is an operation mode other than the air sending mode (FIG. 5: step S310, NO), the display processing unit 160*g* may display a selection request (selection request screen) on the display unit 150*a* to allow a user to select whether or not to set permission. Then, when a selection of not approving rotation frequency control of the fan 40 is input from the indoor operation unit 150 in response to the selection request displayed on the display unit 150*a* (FIG. 5: step S501, NO), the fan control unit 160*a* may set non-permission and the display processing unit 160*g* may display the fact that an abnormality occurs on the display unit 150*a* (FIG. 5: step S502). Further, when permission of rotation frequency control of the fan 40 is input in response to the selection request displayed on the display unit 150*a* (FIG. 5: step S501, YES), the fan control unit 160*a* sets permission, and the display processing unit 160*g* may display the fact that a slight abnormality occurs on the display unit 150*a* (FIG. 5: step S503).

Then, the controller 160 performs processing of steps S313 to S321, as in the case of FIG. 3. Next, the controller 160 performs processing of steps S504 to S506, similarly to steps S501 to S503.

As described above, the air-conditioning system 110 of Embodiment 2 is configured such that the controller 160 provided to the indoor unit 120 analyzes a communication error that occurs in a communication signal transmitted and received between the indoor unit 120 and the outdoor unit 30 to thereby determine whether or not the power fed to the outdoor unit is interrupted. Consequently, it is possible to detect interruption of power feeding from the commercial power supply 500 on the basis of a communication state between the indoor unit 120 and the outdoor unit 30, without adding an additional hardware component. In addition, the controller 60 is configured to determine whether or not to permit start-stop control of the fan 40 and rotation frequency control of the fan 40 by the indoor operation unit 50 on the basis of a communication state with the outdoor unit 30. Consequently, in the air-conditioning system 110, it is possible to change the start-stop state and the air flow rate of the fan even when using the emergency power supply 70.

Further, the air-conditioning system 110 is also configured to select a propriety setting for fan operation when a communication error is an error related to BCP. Consequently, while it is enough to fix the air flow rate of the fan 40 to weak air during energization time, as refrigerant operation cannot be made at the time of BCP, it is possible to respond to a need of changing the air flow rate of the fan 40 to strong air, for example. Further, it is also possible to correspond to a need of performing rotation frequency control of the fan 40 to have an air flow rate to correspond to the environment different from that of the energization time, when the power fed from the commercial power supply 500 to the outdoor unit 30 is interrupted. Further, regarding an error that may be caused by a factor other than power failure, it is possible to attain rotation frequency control of the fan 40 to correspond to a request by a user to set a state where fan operation is not possible with a determination of an abnormal state without fail for priority to safety.

Embodiment 3

Figure 6:
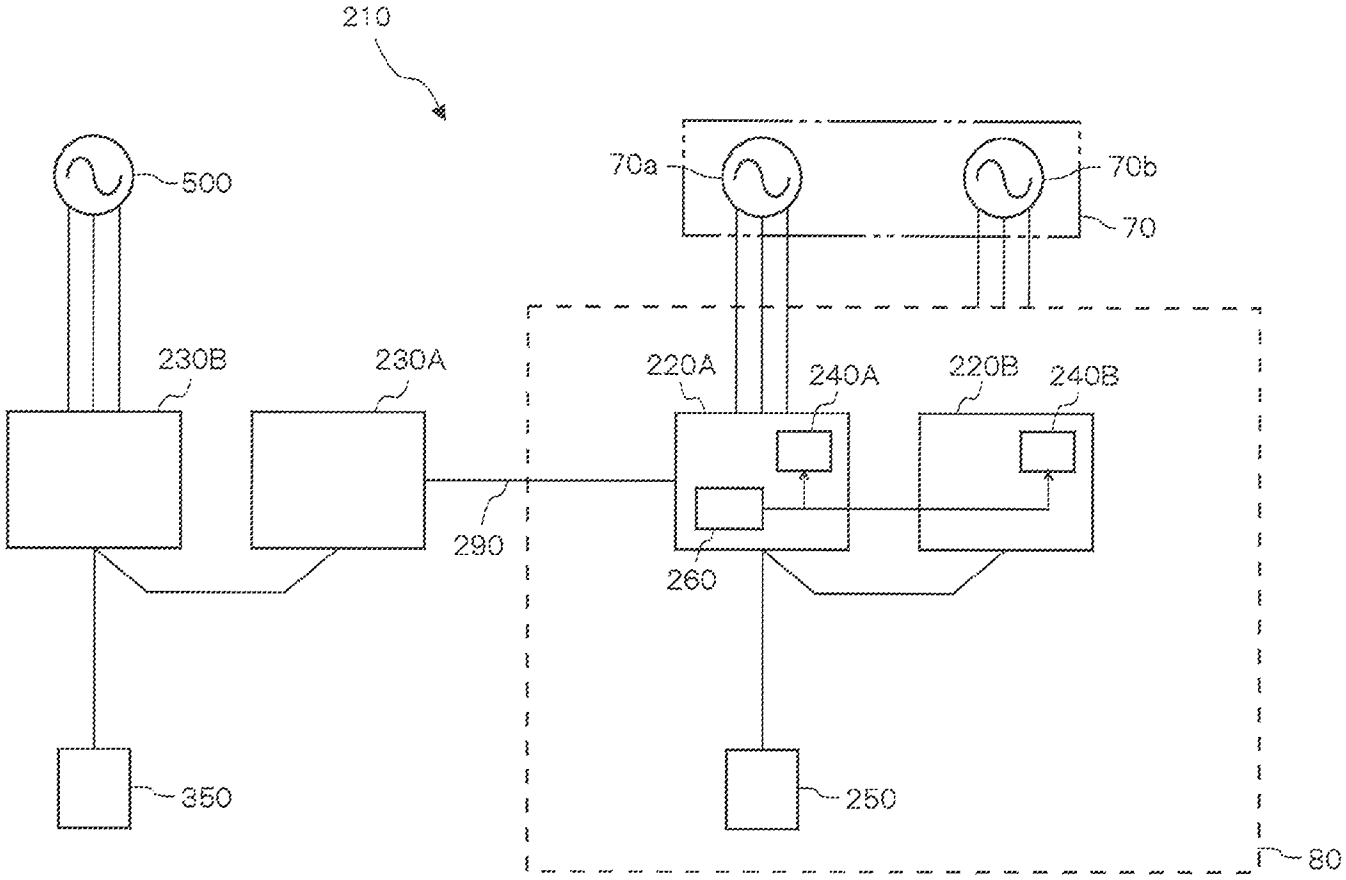
FIG. 6 is a block diagram illustrating a configuration of an air-conditioning system according to Embodiment 3 of the present invention.
Figure 7:
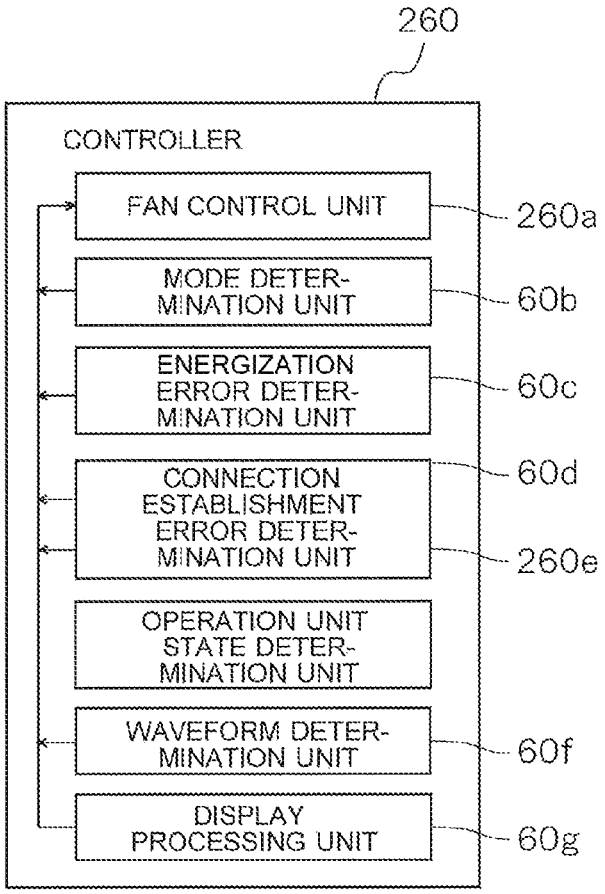
FIG. 7 is a block diagram illustrating a configuration of a controller provided to an indoor unit of the air-conditioning system of FIG. 6.

Next, a configuration of an air-conditioning system 210 of Embodiment 3 will be described with reference to FIG. 3 and FIGS. 5 to 7. FIG. 6 is a block diagram illustrating a configuration of the air-conditioning system 210 according to Embodiment 3. FIG. 7 is a block diagram illustrating a configuration of a controller 260 provided to the air-conditioning system 210. The same components as those of Embodiments 1 and 2 are denoted by the same reference signs and the description is omitted.

As illustrated in FIG. 6, the air-conditioning system 210 includes an indoor unit 220A having a fan 240A, an indoor unit 220B having a fan 240B, an indoor operation unit 250 to which power is fed from the indoor unit 220A and that receives air-conditioning and ventilation operation including driving operation of the fans 240A and 240B, and an emergency power supply 70 that feeds power to the indoor unit 220A when power failure occurs. The emergency power supply 70 includes an indoor unit power supply 70*a* that feeds power to the indoor unit 220A and the indoor unit 220B during an emergency, and a critical-area power supply 70*b* that feeds power to a critical power feeding area 80 including the indoor unit 220A, the indoor unit 220B, and the indoor operation unit 250 during an emergency.

Further, the air-conditioning system 210 includes an outdoor unit 230A to which power is fed from the commercial power supply 500, an outdoor unit 230B connected with the outdoor unit 230A, and an outdoor operation unit 350 to which power is fed from the outdoor unit 230A and that receives air-conditioning and ventilation operation including driving operation of the fans 240A and 240B. The indoor unit 220A and the indoor unit 220B are connected with the outdoor unit 230A and the outdoor unit 230B by refrigerant pipes 290. The indoor unit 220A has a controller 260 having a configuration that is the same as that of the controller 60 or the controller 160 of Embodiment 1 or 2.

As illustrated in FIG. 7, the controller 260 includes a fan control unit 260*a* that performs rotation frequency control including start-stop control of the fan 240A and fan 240B, and an operation unit state determination unit 260*e* that determines whether or not operation control by the indoor operation unit 250 is possible. The operation unit state determination unit 260*e* has a function of distinguishing the indoor operation unit 250 and the outdoor operation unit 350. It should be noted that a state where operation from the indoor operation unit 250 and the outdoor operation unit 350 is impossible, among states where operation control of the fans 240A and 240B is impossible, includes, for example, a state where a user cannot instruct the indoor units 220A and 220B to control the fan 240A because, for example, wiring of the indoor operation unit 250 is disconnected, and a state where power is not fed to the outdoor operation unit 350 because power is fed only from the indoor unit power supply 70*a*.

The operation of the air-conditioning system 210 is the same as that of the air-conditioning systems 10 and 110 in Embodiments 1 and 2 described above. Here, with reference to FIGS. 3 and 5, the operation unit state determination unit 260*e* determines whether or not operation control is possible, for example, by determining whether or not communication with the indoor operation unit 250 is ensured (FIGS. 3 and 5: step S313). This means that the operation unit state determination unit 260*e* determines that operation control is impossible in the case that satisfies not only a condition that communication with the outdoor operation unit 350 is impossible due to interruption of power feeding but also a condition that communication with the indoor operation unit 250 is impossible due to some reasons (FIGS. 3 and 5: step S313, NO). On the other hand, the operation unit state determination unit 260*e* determines that operation control is possible when communication with the indoor operation unit 250 is confirmed (FIGS. 3 and 5: step S313, YES).

As described above, the air-conditioning system 210 of Embodiment 3 is configured such that the controller 260 provided to the outdoor unit 230A analyzes a communication error that occurs in a communication signal transmitted and received between the outdoor units 230A and 230B to determine whether or not the power fed from the commercial power supply 500 is interrupted. This means that, in the air-conditioning system 210, it is possible to detect interruption of the power fed from the commercial power supply 500 to the outdoor units 230A and 230B on the basis of a communication state with the outdoor units 230A and 230B, without providing a configuration of reliably detecting interruption of the power fed to the outdoor units 230A and 230B and interruption of the power fed from the commercial power supply 500 to the outdoor operation unit 350 via the outdoor unit 230B. In addition, the controller 60 is configured to determine whether or not to approve rotation frequency control of the fans 240A and 240B on the basis of a communication state with the outdoor units 230A and 230B. Consequently, in the air-conditioning system 210, it is possible to change the start-stop state and the air flow rate of the fan 240A and 240B even while using the emergency power supply 70.

Further, in a conventional air-conditioning system including both an outdoor remote control and an indoor remote control, power may not be fed to some remote controls. For example, in a state where power is fed only to an indoor unit, power is not fed to the outdoor remote control. In the remote control to which power is not fed, the display screen is turned off, and it is impossible to operate the remote control to stop operation, so that it is impossible to receive start-stop operation at the time of emergency. Consequently, the conventional air-conditioning system is configured to stop driving of the fan provided to the indoor unit in a state where power is not fed to any of the remote controls even when power is fed to the indoor unit.

Meanwhile, the air-conditioning system 210 of Embodiment 3 is configured such that the fan control unit 260*a* approves rotation frequency control of the fans 240A and 240B when fan operation control by the indoor operation unit 250 is possible. Consequently, in the case where the indoor units 220A and 220B are applied with power and power is fed to the indoor operation unit 250, for example, even when power is not fed to the outdoor operation unit 350, the indoor operation unit 250 is able to perform start-stop and rotation frequency control of the fans 240A and 240B.

It should be noted that while FIG. 6 illustrates an example in which the controller 260 that performs rotation frequency control of the fan 240A and the fan 240B is provided to the indoor unit 220A, the present invention is not limited to this configuration. For example, the air-conditioning system 210 may include a controller that is provided to the indoor unit 220A and performs rotation frequency control of the fan 240A in the same manner as that of the controller 260, and a controller that is provided to the indoor unit 220B and controls rotation frequency control of the fan 240B in the same manner as that of the controller 260.

Meanwhile, a conventional air-conditioning system may have a method to issue a notification of power supply interruption of an outdoor unit. However, as a case is assumed where a plurality of indoor units are included, it is impossible to ensure a capacitor capacity sufficient for guaranteeing completion of power supply interruption notification through communication with all of the connected indoor units when power supply of the outdoor unit is lowered. Meanwhile, the air-conditioning systems 10,110, and 210 of Embodiments 1 to 3 described above adopt a configuration of detecting a BCP state by determining the type of an error from the communication state with the outdoor unit 30. Consequently, it is possible to attain ventilation and air conditioning with a minimum configuration without adding a specially designed hardware component.

It should be noted that the embodiments described above are each a preferable specific example of the air-conditioning system. While various technically preferable limitations may be added, the technical scope of the present invention is not limited to these aspects. For example, Embodiments 1 to 3 exemplary show configurations in which each controller is provided to an indoor unit, but the present invention is not limited to this configuration. Each controller may be provided outside the indoor unit in the urgent power feeding area 80. Further, FIGS. 1 and 4 each exemplarily illustrate an air-conditioning system having one indoor unit and one outdoor unit, and FIG. 6 exemplarily illustrates an air-conditioning system including two indoor units and two outdoor units. However, the present invention is not limited to this configuration. This means that the air-conditioning systems according to Embodiments 1 to 3 described above may be configured by appropriately combining one or more indoor units and one or more outdoor units.

Further, FIGS. 1 and 4 each exemplarily illustrate an air-conditioning system including one indoor operation unit, and FIG. 6 exemplarily illustrates an air-conditioning system including both an indoor operation unit and an outdoor operation unit. However, a plurality of indoor operation units and a plurality of outdoor operation units may be provided. In addition, while FIGS. 1, 4, and 6 exemplarily illustrate the cases where the air-conditioning systems 10,110, and 210 are operated by the power fed from the commercial power supply 500 during the energization time, the present invention is not limited to this configuration. For example, each of the indoor unit and the outdoor unit may have a different supply. This means that the indoor unit power supply 70*a* may be a commercial power supply for the indoor unit, and only the urgent power supply 70*b* is provided as an emergency power supply. Furthermore, while the embodiments described above each exemplarily illustrate a configuration in which the emergency power supply 70 includes the indoor unit power supply 70*a* and the urgent power supply 70*b*, the present invention is not limited to this configuration. The emergency power supply 70 may include either the indoor unit power supply 70*a* or the urgent power supply 70*b*.

REFERENCE SIGNS LIST

10, 110, 210 air-conditioning system; 20, 120, 220A, 220B indoor unit; 20*a* decompression device; 20*b* evaporator; 30, 230A, 230B outdoor unit; 30*a* compressor; 30*b* condenser; 30*c* outdoor fan; 40, 240A, 240B fan; 50, 150, 250 indoor operation unit; 50*a*, 150*a* display unit; 60, 160, 260 controller; 60*a*, 160*a*, 260*a* fan control unit; 60*b* mode determination unit; 60*c* energization time error determination unit; 60*d* connection establishment error determination unit; 60*e*, 260*e* operation unit state determination unit; 60*f* waveform determination unit; 60*g*, 160*g* display processing unit; 70 emergency power supply; 70*a* indoor unit power supply; 70*b* urgent power supply; 80 urgent power feeding area; 90, 290 refrigerant pipe; 350 outdoor operation unit; and 500 commercial power supply.

The invention claimed is:

1. An air-conditioning system comprising:

an indoor unit having a fan and being configured to transmit and receive a communication signal;

an outdoor unit connected with the indoor unit via a refrigerant pipe, the outdoor unit being configured to transmit and receive the communication signal to and from the indoor unit, the outdoor unit being configured to feed electric power to the indoor unit from a commercial power supply during an energization period in which the electric power is fed from the commercial power supply to the outdoor unit; and an emergency power supply connected with the indoor unit, the emergency power supply being configured to feed electric power to the indoor unit in response to a power failure in the electric power fed from the commercial power supply to the outdoor unit, the indoor unit further including:

a controller configured to control operation of the fan to correspond to a communication state with the outdoor unit and to determine the cause of a communication error between the indoor unit and the outdoor unit, and an indoor unit remote control to which electric power is fed from the indoor unit, the indoor unit remote control being configured to drive the fan, the controller being further configured to, in response to a communication error occurring in communication with the outdoor unit, determine whether or not the communication error is an energization error that only occurs during the energization period excluding errors that occur during both the energization period and a business continuity plan time, the controller being further configured to, in response to the controller determining that the communication error is not the energization error, determine whether or not the communication error is a connection establishment error occurring at a time of establishing a connection with the outdoor unit, and, in response to the controller determining that the communication error is not the connection establishment error, determine that a power failure has occurred from the electric power fed from the commercial power supply to the outdoor unit, the controller being further configured to determine whether or not the controller can operate the fan in response to the controller determining that the power failure has occurred from the electric power fed from the commercial power supply to the outdoor unit, and the controller being further configured to, in response to the controller determining that the communication with the indoor operation unit is established, drive the fan by the electric power fed from the emergency power supply.

2. The air-conditioning system of claim 1, wherein the controller is further configured to operate in an air sending mode, and a mode of performing air conditioning by allowing refrigerant to flow between the indoor unit and the outdoor unit, the controller is further configured to determine whether or not an operation mode before the electric power fed from the commercial power supply to the outdoor unit is interrupted is the air sending mode, and the controller is further configured to set a permission that permits rotation frequency control of the fan by the indoor unit remote control in response to the controller determining that the communication error is the connection establishment error and the controller determining that the operation mode is the air sending mode.

3. The air-conditioning system of claim 1, wherein the controller is further configured to determine whether or not a waveform deformation is present in the communication signal in response to the controller determining that the communication with the indoor operation unit is established, and the controller is further configured to permit rotation frequency control of the fan in response to the controller determining that the waveform deformation is not present.

4. The air-conditioning system of claim 3, wherein the controller is further configured to operate in an air sending mode, and a mode of performing air conditioning by allowing refrigerant to flow between the indoor unit and the outdoor unit, the controller is further configured to determine whether or not an operation mode before the electric power fed from the commercial power supply to the outdoor unit is interrupted is the air sending mode, and the controller is further configured to set a permission that permits the rotation frequency control of the fan by the indoor unit remote control in response to the controller determining that the waveform deformation is present and the controller determining that the operation mode is the air sending mode.

5. The air-conditioning system of claim 2, wherein the indoor unit remote control includes a display configured to display a selection request of whether or not to permit the rotation frequency control of the fan, and the controller is further configured to control the display of the indoor unit remote control to display the selection request in response to the controller determining that the operation mode is an operation mode other than the air sending mode.

6. The air-conditioning system of claim 5, wherein the controller is further configured to permit the rotation frequency control of the fan by the indoor remote control in response to permission for the rotation frequency control of the fan being input from the indoor unit remote control and the selection request displayed on the display by the controller.

7. The air-conditioning system of claim 1, wherein the outdoor unit is configured to output an error clear request indicating power restoration in response to electric power being restored, and the controller is further configured to determine whether or not the energization error power applied time error occurred in the communication signal after error clear in response to the error clear request being output from the outdoor unit.

* * * * *